US009803963B1

(12) United States Patent
Huang

(10) Patent No.: US 9,803,963 B1
(45) Date of Patent: Oct. 31, 2017

(54) SWING BLADE BROADHEAD

(71) Applicant: Dorge O. Huang, Henry, IL (US)

(72) Inventor: Dorge O. Huang, Henry, IL (US)

( * ) Notice: Subject to any disclaimer, the term of this patent is extended or adjusted under 35 U.S.C. 154(b) by 0 days.

(21) Appl. No.: 15/451,761

(22) Filed: Mar. 7, 2017

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS 7,311,622 B1 * 12/2007 Futtere ..... F42B 6/08 473/583
8,021,251 B1 * 9/2011 Ward ..... F42B 6/08 473/583
8,113,974 B1 * 2/2012 Ward, Jr. ..... F42B 6/08 473/583
8,133,138 B1 * 3/2012 Hannah ..... F42B 6/08 473/583
2010/0113196 A1 * 5/2010 Jones ..... F42B 6/08 473/583
2010/0173734 A1 * 7/2010 Robbins ..... F42B 6/08 473/584

* cited by examiner

*Primary Examiner* — John Ricci
(74) *Attorney, Agent, or Firm* — Donald J. Ersler

(57) ABSTRACT

A swing blade broadhead preferably includes a shank base, a plurality of swing blades, a bullet nose and a plurality of fasteners. The shank base includes an arrow shaft shank, a blade shoulder and a blade base. The blade base preferably includes a plurality of outer flat surfaces and a circular sector formed between two adjacent outer flat surfaces. Each swing blade includes a blade portion and a pintle roll. The blade portion preferably includes a base portion and a tail portion. The pintle roll is formed on one end of the base portion to receive a fastener. The circular sectors are sized to receive an outer perimeter of the pintle roll. A plurality of tapped holes are formed in blade shoulder to threadable receive the plurality of fasteners. The bullet nose includes a plurality of counter bored holes to receive the plurality of fasteners.

20 Claims, 5 Drawing Sheets

SWING BLADE BROADHEAD

BACKGROUND OF THE INVENTION

1. Field of the Invention

The present invention relates generally to archery and more specifically to a swing blade broadhead, which allows quick replacement of the swing blades.

2. Discussion of the Prior Art

It appears that the prior art does not teach or suggest a swing blade broadhead, which includes a plurality of pivoting blades that have an outer perimeter that increases when the plurality of pivoting blades cut into the flesh of a game animal. The pivoting blades include a minimum outer perimeter during flight to optimize aerodynamics.

Accordingly, there is a clearly felt need in the art for a swing blade broadhead, which includes a plurality of pivoting blades that have an outer perimeter that increases when the plurality of pivoting blades cut into the flesh of a game animal; includes a minimum outer perimeter during flight to optimize aerodynamics; and includes the quick replacement of the swing blades.

SUMMARY OF THE INVENTION

The present invention provides a swing blade broadhead, which includes a minimum outer perimeter during flight to optimize aerodynamics. The swing blade broadhead preferably includes a shank base, a plurality of swing blades, a bullet nose, an o-ring and a plurality of fasteners. The shank base preferably includes an arrow shaft shank, a blade shoulder, a blade base and a location pin. The arrow shaft shank extends from one end of the blade shoulder and the blade base extends from an opposing side of the blade shoulder. The blade base preferably includes a location pin bore, a plurality of outer flat surfaces and a circular sector formed between two adjacent outer flat surfaces. A location dowel is pressed into the location pin bore. The location pin bore is formed in a center of the blade base. However, the location dowel may be made as an integral portion of the blade base with a machining operation or a molding operation. Each swing blade includes a blade portion and a pintle roll. The blade portion preferably includes a base portion and a tail portion. The pintle roll is formed on one end of the base portion to receive a fastener. The tail portion extends outward and downward from an opposing end of the base potion. A front blade bevel is formed on a top and front of the tail portion. A rear blade bevel is formed on a bottom and rear of the tail portion.

The circular sectors are sized to receive an outer perimeter of the pintle roll. A plurality of threaded holes are formed in blade shoulder, concentric with the plurality of circular sectors to threadable receive the plurality of fasteners. The bullet nose includes a bullet nose shape, a flat bottom, a nose location pin bore and a plurality of counter bored holes. The nose location pin bore is formed in a bottom of the bullet nose to slidably receive the location pin. The plurality of counter bored holes are formed through a top of the bullet nose. The bullet nose is slid on to the location pin, and the bullet nose is rotated, until the plurality of counter bored holes are aligned with the plurality of threaded holes. The pintle roll of each swing blade is inserted into the plurality of circular sectors. The plurality of fasteners are inserted into the plurality of counterbores and plurality of pintles and threaded into the plurality of threaded holes. However, the location dowel may be eliminated by making the bullet nose as an integral portion of the blade base with a machining operation or a molding operation.

A retention radius is formed on a top of the swing blade at the junction of the base portion and the tail portion. The plurality of swing blades are pushed in against the plurality of flats and the o-ring is rolled into a gap between a bottom of the bullet nose and the plurality of retention radii. The o-ring forces the plurality of swing blades inward toward the blade base to create a minimized outer perimeter. The minimized outer perimeter decreases aerodynamic drag during flight. As the plurality of swing blades enter the flesh of a game animal, the blades open-up relative to the blade base and create a large wound in the flesh of the game animal.

Accordingly, it is an object of the present invention to provide a swing blade broadhead, which includes a plurality of pivoting blades that have an outer perimeter that increases when the plurality of pivoting blades cut into the flesh of a game animal.

Finally, it is another object of the present invention to provide a swing blade broadhead, which includes a minimum outer perimeter during flight to optimize aerodynamics.

These and additional objects, advantages, features and benefits of the present invention will become apparent from the following specification.

DETAILED DESCRIPTION OF THE PREFERRED EMBODIMENTS

Figure 1:
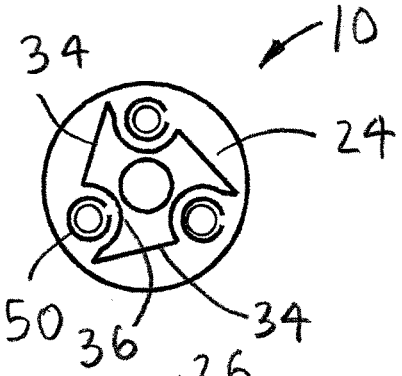
FIG. 1 is a top view of a shank base of a swing blade broadhead in accordance with the present invention.
Figure 3:
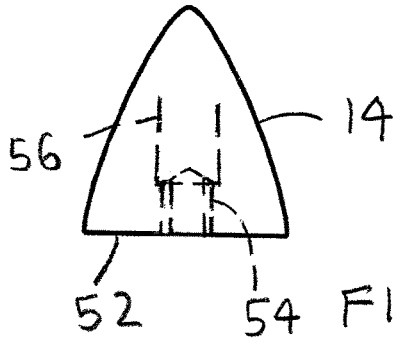
FIG. 3 is a side view of a bullet nose of a swing blade broadhead in accordance with the present invention.
Figure 2:
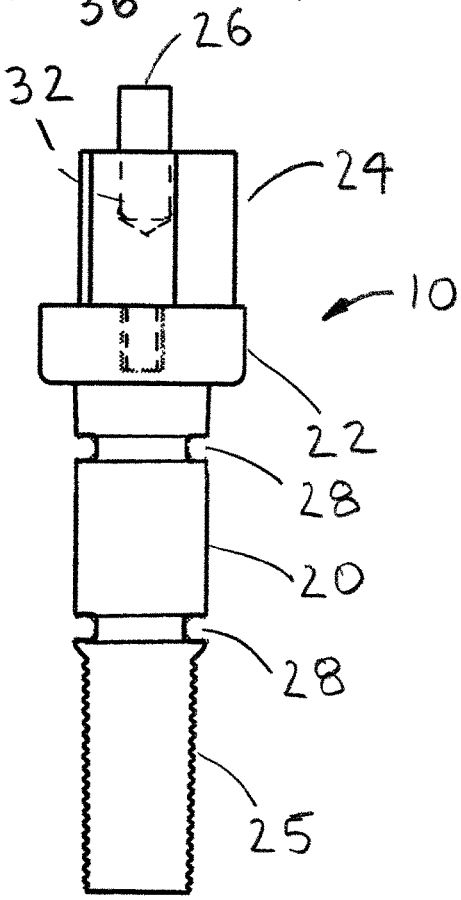
FIG. 2 is a side view of a shank base of a swing blade broadhead in accordance with the present invention.
Figure 4:
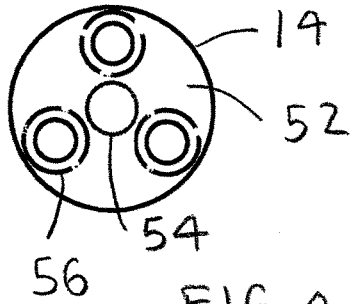
FIG. 4 is a bottom view of a bullet nose of a swing blade broadhead in accordance with the present invention.
Figure 5:
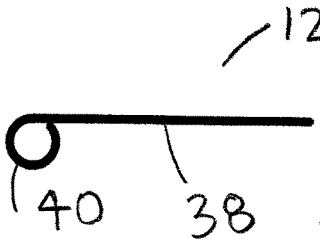
FIG. 5 is a top view of a swing blade of a swing blade broadhead in accordance with the present invention.
Figure 6:
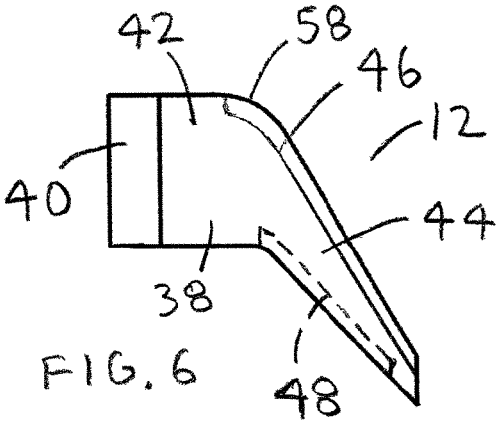
FIG. 6 is a front view of a swing blade of a swing blade broadhead in accordance with the present invention.
Figure 7:
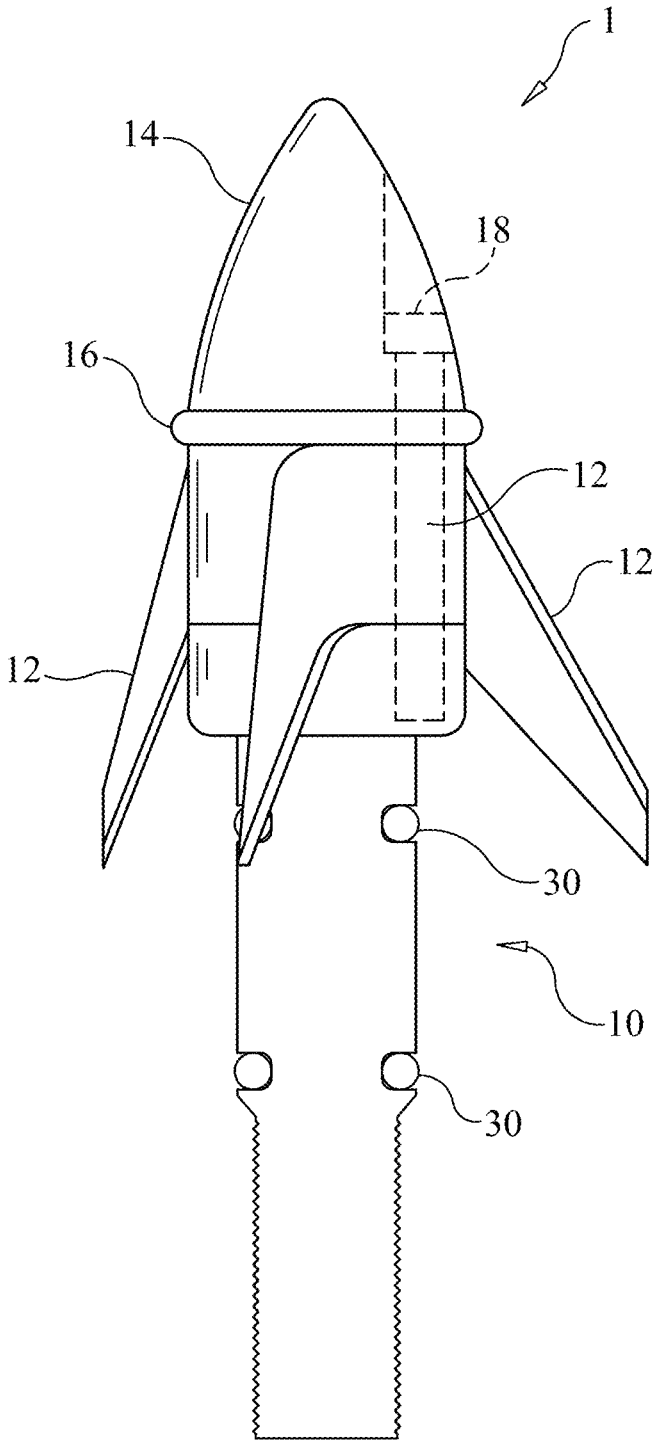
FIG. 7 is a side view of a swing blade broadhead before flight in accordance with the present invention.

With reference now to the drawings, and particularly to FIG. 7, there is shown a side view of a swing blade broadhead 1. With reference to FIGS. 2-6, the swing blade broadhead preferably includes a shank base 10, a plurality of swing blades 12, a bullet nose 14, an o-ring 16 and a plurality of fasteners 18. The shank base 10 includes an arrow shaft shank 20, a blade shoulder 22, a blade base 24 and a location dowel 26. The arrow shaft shank 20 extends from one end of the blade shoulder 22 and the blade base 24 extends from an opposing side of the blade shoulder 22. The blade shoulder 22 could also be considered an integral portion of said blade base 24. Two o-ring grooves 28 are preferably formed in the arrow shaft shank 20 to receive two shank o-rings 30. An arrow tube thread 25 is formed on an end of the arrow shaft shank 20. The blade base 24 preferably includes a location pin bore 32, a plurality of outer flat surfaces 34 and a circular sector 36 formed between two adjacent outer flat surfaces 34. The location dowel 26 is pressed into the location pin bore 32. The location pin bore 32 is formed in a center of the blade base 24. However, the location dowel 26 may be made as an integral portion of the blade base 24 with a machining operation or a molding operation. Each swing blade 12 includes a blade portion 38 and a pintle roll 40. The blade portion 38 preferably includes a base portion 42 and a tail portion 44. The pintle roll 40 is formed on one end of the base portion 42 to receive the fastener 18. The fastener 18 is preferably a threaded fastener, but other fasteners could also be used, such as a dowel pin. The tail portion 44 extends outward and downward from an opposing end of the base potion 42. A front blade bevel 46 is formed on a top and front of the tail portion 44. A rear blade bevel 48 is formed on a bottom and rear of the tail portion 44.

Figure 8:
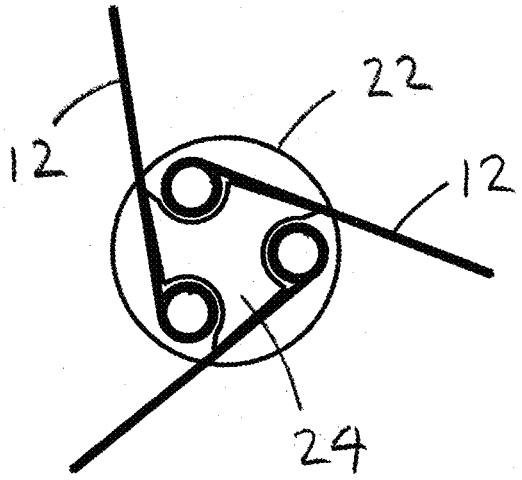
FIG. 8 is a top view of a swing blade broadhead before flight with a bullet nose removed in accordance with the present invention.

The circular sectors 36 are sized to receive an outer perimeter of the pintle roll 40. A plurality of threaded holes 50 are formed in the blade shoulder 24, concentric with the plurality of circular sectors 36 to threadable receive the plurality of fasteners 18. The bullet nose 14 includes a bullet nose shape, a flat bottom 52, a nose location pin bore 54 and a plurality of counter bored holes 56. The nose location pin bore 54 is formed in the flat bottom 52 of the bullet nose 14 to slidably receive the location pin 26. The plurality of counter bored holes 56 are formed through a top of the bullet nose 14. The bullet nose 14 is slid on to the location pin 26, and the bullet nose 14 is rotated, until the plurality of counter bored holes 56 are aligned with the plurality of the threaded holes 50. With reference to FIG. 8, the pintle roll 40 of each swing blade 12 is inserted into the plurality of circular sectors 36. The plurality of fasteners 18 are inserted into the plurality of counterbores 56 and plurality of pintle rolls 40; and threaded into the plurality of threaded holes 50. However, the location dowel 26 may be eliminated by making the bullet nose 14 as an integral portion of the blade base 24 with a machining operation or a molding operation.

Figure 9:
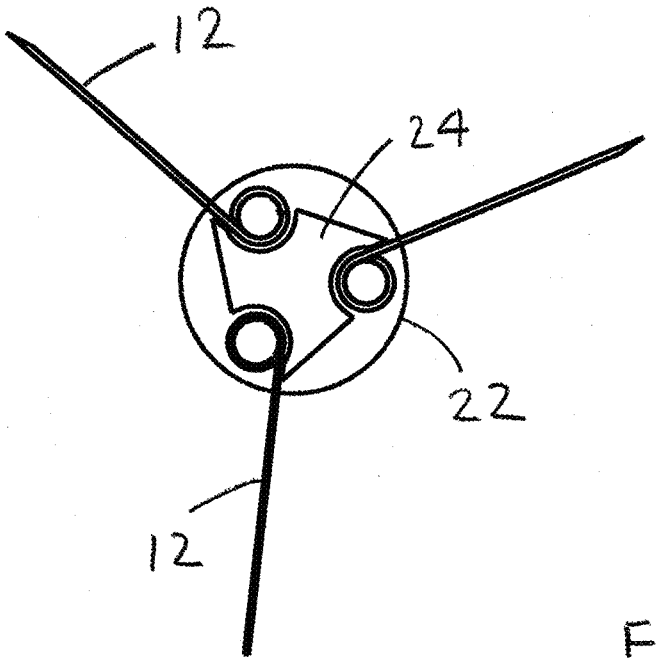
FIG. 9 is a top view of a swing blade broadhead after penetration into a game animal with a bullet nose removed in accordance with the present invention.
Figure 10:
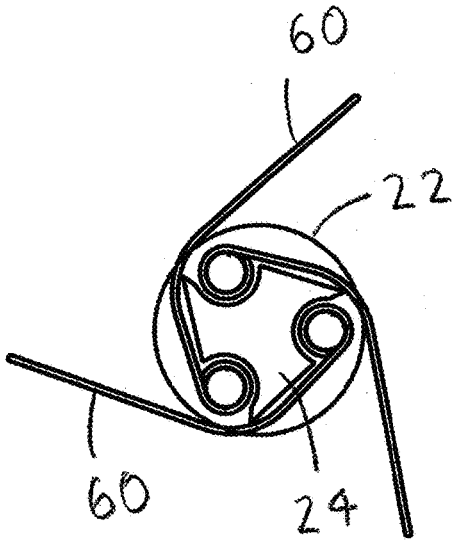
FIG. 10 is a top view of a swing blade broadhead with a first alternative swing blade; with a bullet nose removed; and before flight in accordance with the present invention.
Figure 11:
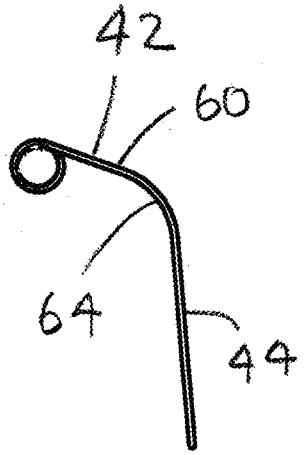
FIG. 11 is a top view of a first alternative swing blade of a swing blade broadhead in accordance with the present invention.
Figure 12:
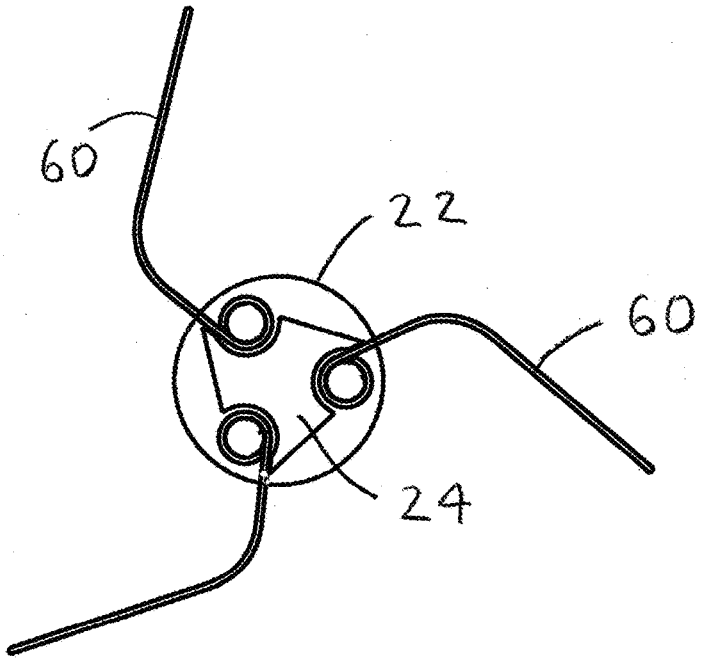
FIG. 12 is a top view of a swing blade broadhead with a first alternative swing blade; with a bullet nose removed; and after penetration into a game animal in accordance with the present invention.
Figure 13:
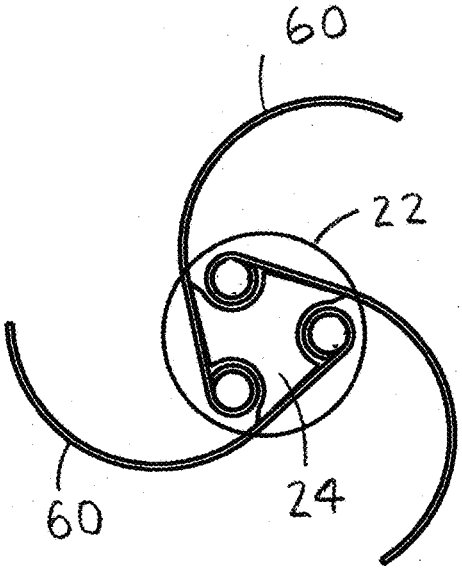
FIG. 13 is a top view of a swing blade broadhead with a second alternative swing blade; with a bullet nose removed; and before flight in accordance with the present invention.
Figure 14:
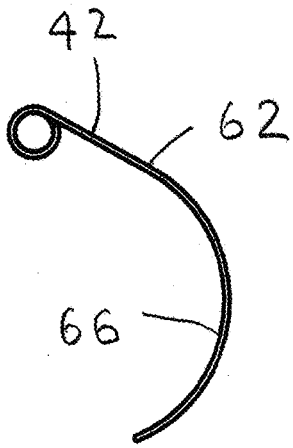
FIG. 14 is a top view of a second alternative swing blade of a swing blade broadhead in accordance with the present invention.
Figure 15:
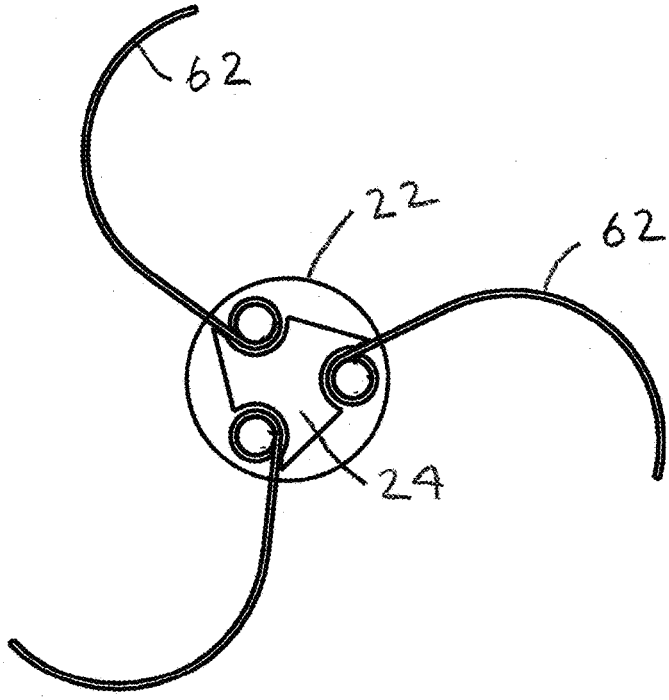
FIG. 15 is a top view of a swing blade broadhead with a second alternative swing blade; with a bullet nose removed; and after penetration into a game animal in accordance with the present invention.

A retention radius 58 is formed on a top of the swing blade 12 at the junction of the base portion 42 and the tail portion 44. The plurality of swing blades 12 are pushed in against the plurality of flats 34 and the o-ring 16 is rolled into a gap between a bottom of the bullet nose 14 and the plurality of retention radii 58. The o-ring 16 biases the plurality of swing blades 12 inward toward the blade base 24 to create a minimized outer perimeter. The minimized outer perimeter decreases aerodynamic drag during flight. With reference to FIG. 9, as the plurality of swing blades 12 enter flesh of a game animal, the swing blades 12 open-up relative to the blade base 24 and create a large wound in the flesh of the game animal.

With reference to FIGS. 10-15, a first alternative swing blade 60 and a second alternative swing blade 62 may be substituted for the swing blade 14. The first and second alternative swing blades 60, 62 include the pintle roll 40, the base portion 42 and the tail portion 44 of the swing blade 14. The first alternative swing blade 60 includes a horizontal curved junction 66 formed between the base portion 42 and the tail portion 44. The second alternative swing blade 62 includes a horizontal curved tail portion 66.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A swing blade broadhead comprising:

a shank base includes an arrow shaft shank, a blade base and a nose section, said arrow shaft shank extends from a bottom of said blade base, said nose section extends from a top of said blade base, a plurality of holes are formed through said nose section;

a plurality of swing blades each having a blade portion and a pintle roll extending from said blade portion; and at least one of a plurality of pins and fasteners are inserted through said plurality of holes and said plurality of pintle rolls, said at least one of said plurality of pins and fasteners are retained at a bottom of said blade base, wherein said plurality of swing blades pivot relative to said shank base.

2. The swing blade broadhead of claim 1 wherein:

a front blade bevel is formed on a top and front of said blade portion, a rear blade bevel is formed on a bottom and rear of said blade portion.

3. The swing blade broadhead of claim 1 wherein:

a plurality of circular sectors are formed in a perimeter of said blade base, each one of said plurality of circular sectors are sized to provide clearance for said pintle roll.

4. The swing blade broadhead of claim 3 wherein:

a plurality of flats are formed in said perimeter of said blade base, each one of said plurality of circular sectors is formed between two adjacent flats of said plurality of flats.

5. The swing blade broadhead of claim 1 wherein:

at least one shank o-ring groove is formed in said arrow shaft shank to receive at least one shaft o-ring.

6. The swing blade broadhead of claim 1, further comprising:

an o-ring biases a top of said plurality of swing blades inward toward said shank base.

7. The swing blade broadhead of claim 1 wherein:

said plurality of fasteners are a plurality of threaded fasteners.

8. A swing blade broadhead comprising:

a shank base includes an arrow shaft shank, a blade base and a nose section, said arrow shaft shank extends from a bottom of said blade base, said nose section extends from a top of said blade base, a plurality of fastener holes are formed through said nose section;

a plurality of swing blades each having a blade portion and a pintle roll extending from said blade portion, said blade portion includes a base portion and a tail portion, said tail portion extends outward and downward from said tail portion; and a plurality of fasteners are inserted through said plurality of fastener holes and said plurality of pintle rolls, said plurality of fasteners are retained at a bottom of said blade base, wherein said plurality of swing blades pivot relative to said shank base.

9. The swing blade broadhead of claim 8 wherein:

a front blade bevel is formed on a top and front of said tail portion, a rear blade bevel is formed on a bottom and rear of said tail portion.

10. The swing blade broadhead of claim 8 wherein:

a retention radius is formed on a top edge junction of said base portion and said tail portion.

11. The swing blade broadhead of claim 10 wherein:

an o-ring biases said retention radius inward toward said shank base.

12. The swing blade broadhead of claim 8 wherein:

a plurality of circular sectors are formed in a perimeter of said blade base, each one of said plurality of circular sectors are sized to provide clearance for said pintle roll.

13. The swing blade broadhead of claim 12 wherein:

a plurality of flats are formed in said perimeter of said blade base, each one of said plurality of circular sectors is formed between two adjacent flats of said plurality of flats.

14. The swing blade broadhead of claim 8 wherein:

at least one shank o-ring groove is formed in said arrow shaft shank to receive at least one shaft o-ring.

15. A swing blade broadhead comprising:

a shank base includes an arrow shaft shank, a blade base and a location dowel, said arrow shaft shank extends from a bottom of said blade base, said location dowel extends from a top of said blade base;

a plurality of swing blades each having a blade portion and a pintle roll extending from said blade portion;

a nose member includes a plurality of fastener holes and a dowel bore; and a plurality of fasteners are inserted through said plurality of fastener holes and said plurality of pintle rolls, said location dowel is inserted into said dowel bore, said plurality of fasteners are retained at a bottom of blade base, wherein said plurality of swing blades pivot relative to said shank base.

16. The swing blade broadhead of claim 15 wherein:

a front blade bevel is formed on a top and front of said blade portion, a rear blade bevel is formed on a bottom and rear of said blade portion.

17. The swing blade broadhead of claim 15 wherein:

a plurality of circular sectors are formed in a perimeter of said blade base, each one of said plurality of circular sectors are sized to provide clearance for said pintle roll.

18. The swing blade broadhead of claim 17 wherein:

a plurality of flats are formed in said perimeter of said blade base, each one of said plurality of circular sectors is formed between two adjacent flats of said plurality of flats.

19. The swing blade broadhead of claim 15 wherein:

an o-ring biases a top of said plurality of swing blades inward toward said shank base.

20. The swing blade broadhead of claim 15 wherein:

said plurality of fasteners are a plurality of threaded fasteners.

* * * * *